US009624000B1

(12) United States Patent
McLaughlin et al.

(10) Patent No.: US 9,624,000 B1
(45) Date of Patent: Apr. 18, 2017

(54) ARTICLE HOLDING TRAY

(71) Applicants: Sonya McLaughlin, Downington, PA (US); Brian McLaughlin, Downingtown, PA (US)

(72) Inventors: Sonya McLaughlin, Downington, PA (US); Brian McLaughlin, Downingtown, PA (US)

( * ) Notice: Subject to any disclaimer, the term of this patent is extended or adjusted under 35 U.S.C. 154(b) by 0 days.

(21) Appl. No.: 15/044,849

(22) Filed: Feb. 16, 2016

Related U.S. Application Data

(60) Provisional application No. 62/117,531, filed on Feb. 18, 2015.

(51) Int. Cl.
*B65D 21/08* (2006.01)
*A47D 15/00* (2006.01)

(52) U.S. Cl.
CPC ..... *B65D 21/083* (2013.01); *A47D 15/00* (2013.01)

(58) Field of Classification Search
CPC .... B65D 21/083; B65D 21/08; B65D 21/086; B65D 21/0233; B65D 21/0201; B65D 21/0204; B65D 5/0005; A47D 15/00
USPC ..... 220/4.27, 4.26, 8, 6, 4.01, 23.83, 23.88, 220/23.87, 23.86, 23.2, 504, 500, 502; 206/507, 505, 745, 758; 224/575, 586
See application file for complete search history.

(56) References Cited

U.S. PATENT DOCUMENTS

| | | | | |
|---|---|---|---|---|
| 1,050,205 | A | 1/1913 | Conley | |
| 2,526,576 | A | 10/1950 | Nelson | |
| 2,540,685 | A | 2/1951 | Mayer | |
| 2,766,455 | A | 10/1956 | Klaine | |
| 3,597,763 | A | 8/1971 | Bienvenu | |
| 4,165,123 | A | 8/1979 | Hutson | |
| 5,192,019 | A * | 3/1993 | Meehan | B65D 5/324 220/8 |
| 5,979,725 | A * | 11/1999 | Lehrman | B60R 7/02 220/23.87 |
| 7,717,504 | B2 | 5/2010 | Centracco et al. | |
| 8,727,435 | B2 | 5/2014 | Centracco et al. | |
| 2006/0124647 | A1 * | 6/2006 | Rosenberg | A47B 88/20 220/500 |
| 2012/0286546 | A1 | 11/2012 | Ballard et al. | |

* cited by examiner

*Primary Examiner* — Robert J Hicks
(74) *Attorney, Agent, or Firm* — Goldstein Law Offices, P.C.

(57) ABSTRACT

A portable article holding device for catching articles which may fall from a user's hands towards the floor when a user is sitting in a chair, such as a high chair. The device has an open top, and includes a pair of front receptacles configured for operably expanding and contracting into one another, and a pair of arm receptacles, each of which can be operably expanded and contracted into an associated front receptacle. When thus configured, the device can adjustably deploy to create a full receptacle perimeter around users having variable body shapes and sizes. In an example embodiment, the device further includes a pair of arm receptacle subsets which expand and contract to further vary the width of each arm receptacle. When in a retracted position, the device can further include a selectively removable cover sized to close the open top of the device.

16 Claims, 18 Drawing Sheets

ARTICLE HOLDING TRAY

CROSS REFERENCES AND RELATED SUBJECT MATTER

This application is a non-provisional filing of provisional patent application Ser. No. 62/117,531, filed in the United States Patent Office on Feb. 18, 2015, from which priority is claimed and which is incorporated herein by reference in its entirety.

TECHNICAL FIELD

The present disclosure relates generally to an article holding device. More particularly, the present disclosure relates to an article holding device which can be adjustably oriented around a user to catch articles which may fall out of reach when the user is seated in a chair, such as a high chair or a car seat.

BACKGROUND

Throughout the course of a day, young children can engage an array of items, ranging from food, baby items, such as bottles, and toys. Many young children, however, often struggle to securely grip these items when they are using them, causing them to plummet to the floor. This is especially frustrating to a child and his parents when the child is sitting in an infant and toddler chair and the item falls to the floor out of the child's reach.

Many of these chairs, such as traditional car seats don't have front surfaces on which the child can place the items, and so the items fall to the floor of the vehicle. The ensuing cries and tantrums of the child often distract the parents while driving. This can lead to potentially hazardous driving conditions, especially when the parents should try to reach and retrieve the item for the child without first pulling over.

Several other chairs, such as high chairs and booster chairs and seats pose the same problem. Many of these chairs are sized to leave ample unoccupied space between the chair's frame and the perimeter of the child's body. While ideal to enable use of the chair for children of varying sizes and widths, the resulting space, however, also enables the items to fall into the child's lap and through the space towards the floor. For instance, a high chair often has a front tray surface. The front tray surface of a high chair, however, is often set far enough from the front of a child's body that a dropped item, such as a bottle or a piece of food, can easily slip therebetween. Further, falling items are even more prevalent with chairs having no front surface, such as many booster chairs, where the unoccupied space is even more accessible.

Yet further, the item can become logged between the chair and the sides of the child's body, becoming difficult for an infant with limited fine motor skills to dislodge. In all scenarios, the parents must again interrupt what they are doing to retrieve the item for the child.

As a result, an array of devices have been designed which serve to enlarge the outer perimeter of a tray surface and/or to create a tray surface where there wasn't one before, to mitigate the likelihood that an item will fall to the floor. Yet other devices have an inner perimeter which cinches around the child's body when the child is seated within a chair. However, these devices are often large and difficult to employ for use with existing furniture and when transitioning between variable settings. Additionally, the child can find the cinching component uncomfortable and restricting when trying to maintain some mobility when seated.

While these units may be suitable for the particular purpose employed, or for general use, they would not be as suitable for the purposes of the present disclosure as disclosed hereafter.

In the present disclosure, where a document, act or item of knowledge is referred to or discussed, this reference or discussion is not an admission that the document, act or item of knowledge or any combination thereof was at the priority date, publicly available, known to the public, part of common general knowledge or otherwise constitutes prior art under the applicable statutory provisions; or is known to be relevant to an attempt to solve any problem with which the present disclosure is concerned.

While certain aspects of conventional technologies have been discussed to facilitate the present disclosure, no technical aspects are disclaimed and it is contemplated that the claims may encompass one or more of the conventional technical aspects discussed herein.

BRIEF SUMMARY

An aspect of an example embodiment of the present disclosure provides a portable device for catching articles which may fall from a user's hands towards the floor when a user is sitting in a chair, such as a high chair, a wheel chair, or a car seat. Accordingly, the present disclosure provides an article holding device having an open top to receive the articles, the device which is deployable and retractable for portable use of the device within variable settings.

Another aspect of an example embodiment of the present disclosure provides the article holding device which can be adjusted to fit around users of varying sizes and shapes. Accordingly, the present disclosure provides the device including at least a pair of expandable front receptacles and a pair of expandable arm receptacles, each of which can be expanded and contracted uniformly or independently of the others. The device can adjust to the size of the user and the seat within which the device is deployed to create a full holding perimeter around the user.

A further aspect of an example embodiment of the present disclosure provides the article holding device which can be oriented around the sides of a user when minimal unoccupied space remains between a user and a chair. Accordingly, the present disclosure provides the device wherein each of the expandable arm receptacles are further divided to create a pair of arm receptacle subsets which contract into one another to reduce the width of each arm receptacle such that they can fit and be inserted around the sides of the user seated in the chair.

Yet a further aspect of an example embodiment of the present disclosure provides the article holding device which can be used to carry the articles within the variable settings, and which enables functional use of the device as a work and play surface. Accordingly, the present disclosure provides the device including a removable cover sized to close the open top of the device when it is in a retracted position.

Accordingly, the present disclosure describes a portable article holding device for catching articles which may fall from a user's hands towards the floor when a user is sitting in a chair, such as a high chair. The device has an open top, and includes a pair of front receptacles configured for operably expanding and contracting into one another, and a pair of arm receptacles, each of which can be operably expanded and contracted into an associated front receptacle. When thus configured, the device can adjustably deploy to create a full receptacle perimeter around users having variable body shapes and sizes. In an example embodiment, the device further includes a pair of arm receptacle subsets which expand and contract to further vary the width of each arm receptacle. When in a retracted position, the device can further include a selectively removable cover sized to close the open top of the device.

The present disclosure addresses at least one of the foregoing disadvantages. However, it is contemplated that the present disclosure may prove useful in addressing other problems and deficiencies in a number of technical areas. Therefore, the claims should not necessarily be construed as limited to addressing any of the particular problems or deficiencies discussed hereinabove. To the accomplishment of the above, this disclosure may be embodied in the form illustrated in the accompanying drawings. Attention is called to the fact, however, that the drawings are illustrative only. Variations are contemplated as being part of the disclosure.

BRIEF DESCRIPTION OF THE DRAWINGS

In the drawings, like elements are depicted by like reference numerals. The drawings are briefly described as follows.

The present disclosure now will be described more fully hereinafter with reference to the accompanying drawings, which show various example embodiments. However, the present disclosure may be embodied in many different forms and should not be construed as limited to the example embodiments set forth herein. Rather, these example embodiments are provided so that the present disclosure is thorough, complete and fully conveys the scope of the present disclosure to those skilled in the art.

DETAILED DESCRIPTION OF THE PREFERRED EMBODIMENTS

Figure 1:
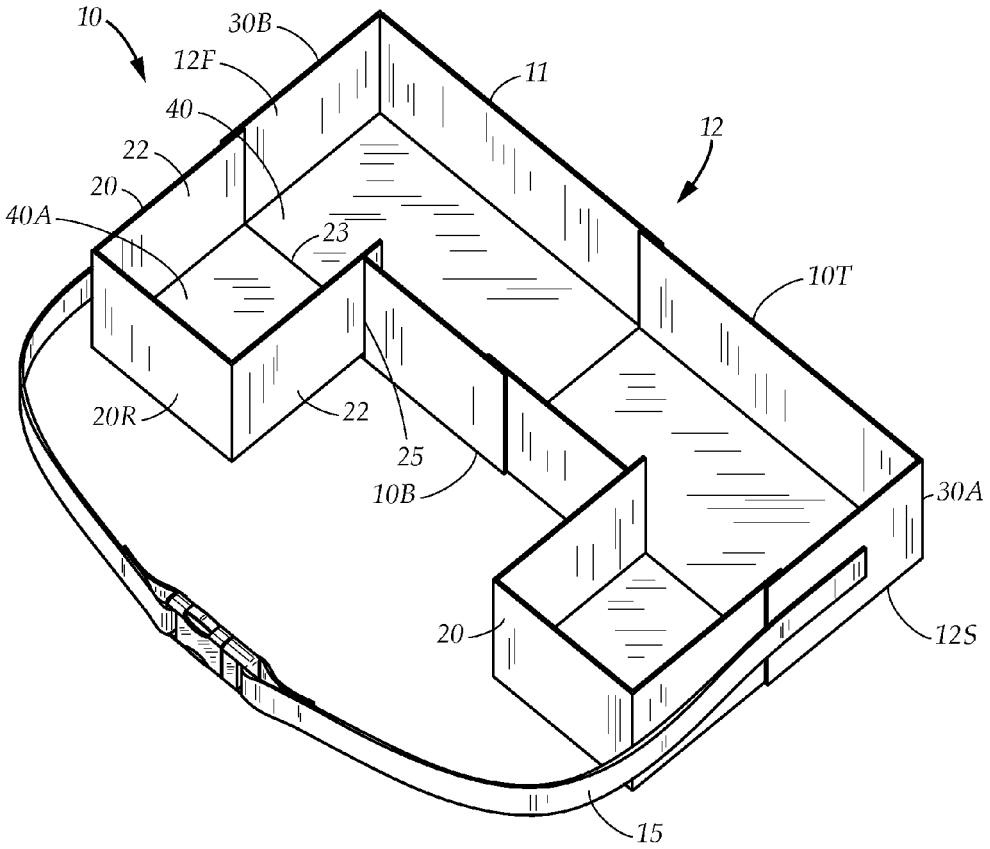
FIG. 1 is a diagrammatic perspective view of a first example embodiment of the article holding device, according to the present disclosure.

FIG. 1 illustrates an example embodiment of a portable article holding device 10 which can be adjusted to fit around a user's body when the user is sitting in a chair, and which can be oriented around the sides of a user when minimal unoccupied space remains between the user and the chair. The device 10 has a top 10T and a bottom 10B, is generally open at the top 10T, and closed at the bottom 10B, and has a front portion 12 which can be operably positioned around the front of the body, such as over a user's lap, to catch any articles which may fall from a user's hands towards the floor, thereby keeping the articles within the user's reach. Such articles include, but are not limited to, food, toys, writing implements, bottles, and cups. The present disclosure is described within the context of a child user and a youth chair, such as a high chair, a booster seat, and a car seat. It is understood, however, that this device can be operably employed by any user having limited fine motor skills and/or who spends at least a portion of their day in a chair. Such individuals include, but are not limited to a senior user and any other user with developmental delays and disabilities.

Further, while the device 10 can be used to catch falling articles as described hereinabove, it can also be used for intentionally storing and enabling easy access to said articles.

Figure 7:
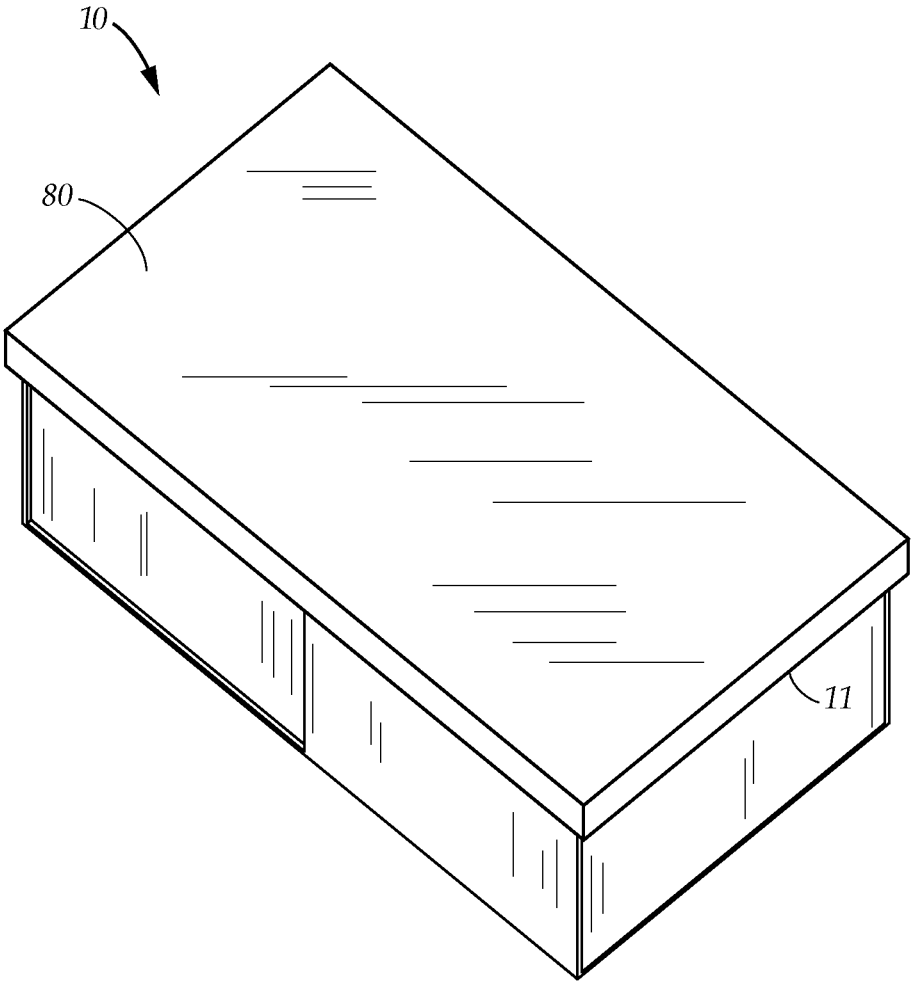
FIG. 7 is a diagrammatic perspective view of the first example embodiment of the device including a cover for enhancing the portability of the device while storing a plurality of articles therein.

The device 10 includes a pair of adjustable arm receptacles 20 and at least a pair of adjustable front receptacles 30 extending substantially perpendicularly between the arm receptacles. The front receptacles 30 and arm receptacles 20 are defined via a base portion 40 and a plurality of walls upwardly extending from the base 40 defining an interior volume within which the articles can fall or be held. The device 10 is adjustable via the expanding and contracting of the receptacles 20,30 which are sized and configured for sliding within one another between a retracted position and a deployed position, as illustrated in FIGS. 2A-2E. As noted, the device 10 has an open top 11. Additionally, the device 10 can include a cover 80 sized to fit over the top 11 to enable functional use of the device as a work and/or play surface, as illustrated in FIG. 7. The cover 80 further enhances the portability of the device 10 such that the user can carry the articles within a variety of settings.

Figure 2A:
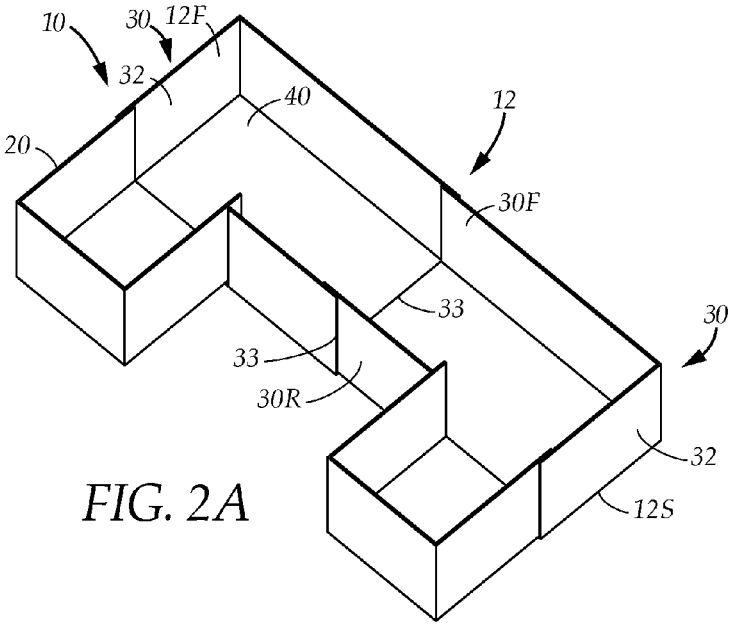
FIG. 2A is a diagrammatic perspective view of the device in a fully deployed position, according to the present disclosure.
Figure 5:
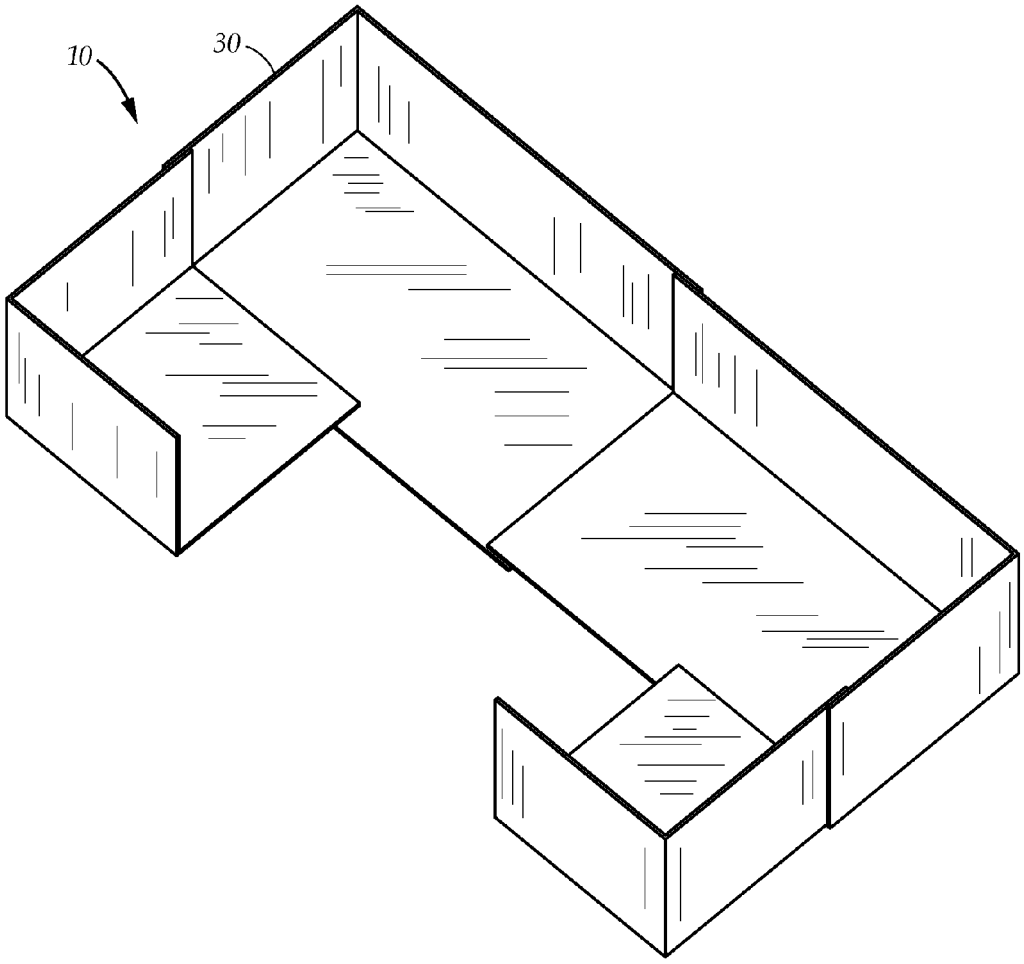
FIG. 5 is a diagrammatic perspective view of a second example embodiment of the article holding device, according to the present disclosure.

When operably coupled to slide within one another, the pair of front receptacles 30 define the front portion 12 having a first end 12F, a second end 12S, and a width extending between the first end 12F and the second end 12S. Referring now to FIGS. 1 and 2A, each of the front receptacles 30 includes a longitudinally extending front wall 30F and a directly opposing rear wall 30R, each wall 30F, 30R extending along the width of the front portion 12. The walls 30F, 30R extend upwardly substantially perpendicularly from the base 40. Each of the front receptacles 30 further includes an outer side wall 32 extending upwardly substantially perpendicularly from the base 40, forming a right angle with the front walls 30F at the first end 12F and second end 12S of the front portion 12, respectively. Further, each of the front receptacles 30 includes an open, interior lateral edge 33 extending between the front wall 30F and the rear wall 30R, fully opposite from the outer side wall 32. The rear walls 30R of each front receptacle 30 extend partially from each interior edge 33 towards the outer side wall 32 of that front receptacle 30, without coming into contact with either outer side wall 32. The front portion 12 is configured to extend across the user's body, such that the rear walls 30R are oriented adjacent and parallel to the front of a user's body. It is understood that the device 10 can be rotated and placed in various positions around the user's body to accommodate bodies and chairs of variable shapes and sizes. In another example embodiment illustrated in FIG. 5, the front receptacles 30 do not include the rear walls 30R to enable a more contoured fit of the device 10 against the user's body.

Figure 8:
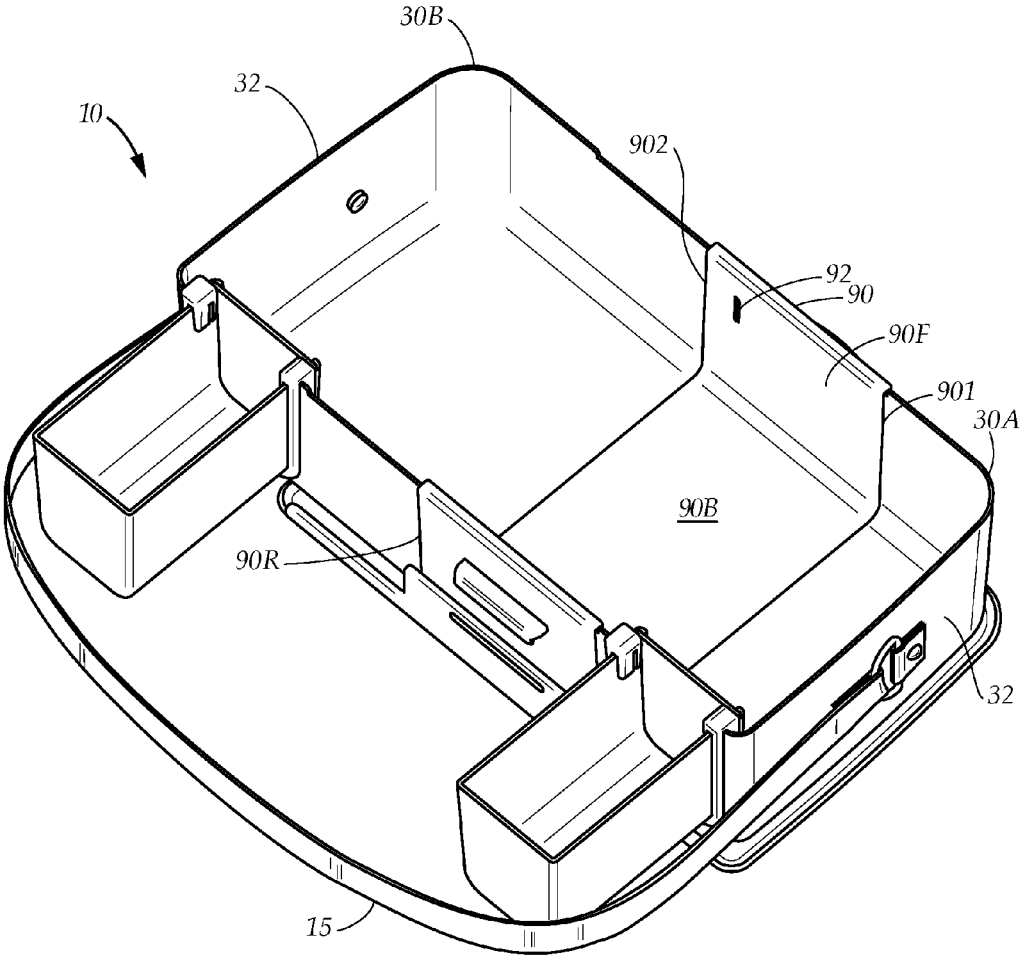
FIG. 8 is a diagrammatic perspective view of a fourth example embodiment of the article holding device, having a center front sleeve.

Referring back to FIG. 1, the device 10 can further include a strap 15 for securing the device 10 around a user's body when the user is seated in a chair. The strap can be adjustable. The strap 15 can be unitary and operably coupled at outer side walls 32 of the front receptacles (as in the embodiment of FIG. 8), and/or it can comprise at least a pair of straps which couple, such as via a fastener, at a point around the user's body, as illustrated in FIG. 1.

As described hereinabove, a user can adjust the width of the front portion 12 to enable use of the device 10 with users of variable shapes and sizes. In the example embodiment illustrated in FIG. 1, a first front receptacle 30A is smaller in profile than a second front receptacle 30B. Accordingly, the device 10 can be telescoping via the orientation of the first front receptacle 30A within the second front receptacle 30B such that the first receptacle 30A is configured for sliding inwardly and outwardly over the second receptacle 30B, expanding and contracting the width of the front portion 12. The front receptacles 30A, 30B can be fully separated. Alternatively, the front receptacles 30A, 30B can include a guiding mechanism, such as a track within which the walls of the first front receptacle are configured to slide, and which can be configured for locking at the user's desired width.

FIG. 1 further illustrates the adjustable arm receptacles 20 oriented at the ends 12F, 12S of the front portion 12. Each arm receptacle 20 has a base panel 40A and a pair of directly opposing arm side walls 22 extending upwardly substantially perpendicularly from the base. Each arm receptacle 20 also includes an upwardly extending arm rear wall 20R having a width extending between the side walls 22. The base panel 40A may have has an interior edge 23 directly opposing each arm rear wall 20R, which may be open as illustrated. As described hereinabove, the front receptacle rear wall 30R and the outer side wall 32 of each front receptacle 30 frame a receptacle opening 25. Each opening has an approximately equal to the width of each arm rear wall 20R. Accordingly, each arm receptacle 20 is configured for expanding from and contracting within an associated front receptacle 30 via the opening using the methods and mechanisms as described hereinabove with the telescoping front receptacles 30. When the device 10 is fully deployed, the front receptacles 30 and arm receptacles 20 may form a main cavity, a unitary or substantially uninterrupted space within which articles can be contained.

Figure 2B:
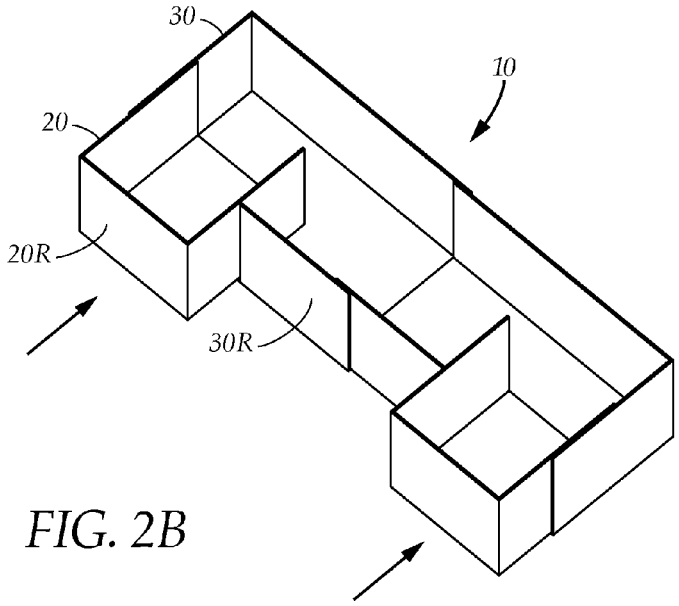
FIG. 2B is a diagrammatic perspective view of the device including a pair of adjustable arm receptacles in a partially contracted position, according to the present disclosure.
Figure 2C:
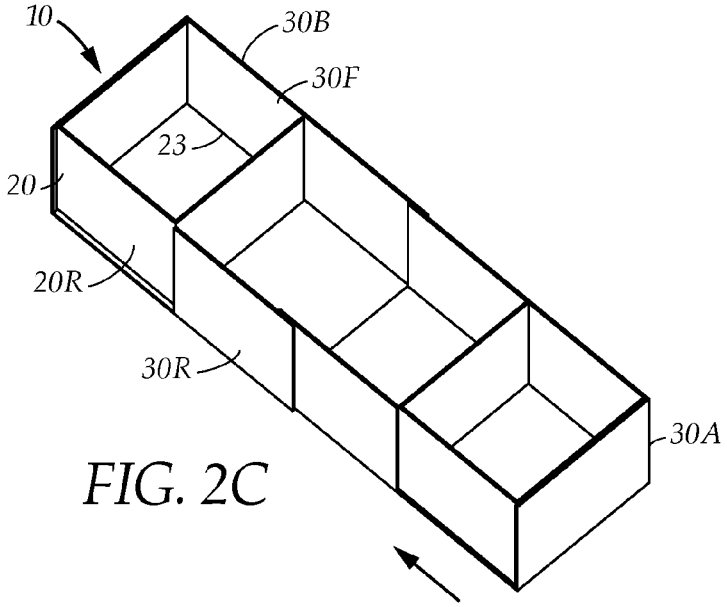
FIG. 2C is a diagrammatic perspective view of the device including the arm receptacles fully contracted into a pair of front receptacles, according to the present disclosure.

In an example embodiment, the arm receptacles 20 retract fully into the front receptacles 30 such that the front walls 30F extends along the open interior edges 23 of the arm receptacles 20, and the rear walls 20R of the arm receptacles 20 are substantially aligned with the rear walls 30R of the front receptacles 30, as illustrated in FIG. 2C. In a further example embodiment illustrated in FIG. 6B, the width of each arm receptacle 30 is divided to create a pair of arm subsets 71,72 configured for contracting and expanding into each other such that the width of the arm receptacles 30 can be varied from user to user. It is understood, that each arm receptacle 30 and pair of arm subsets 71,72 can be adjusted independently of the other and/or uniformly.

Figure 6A:
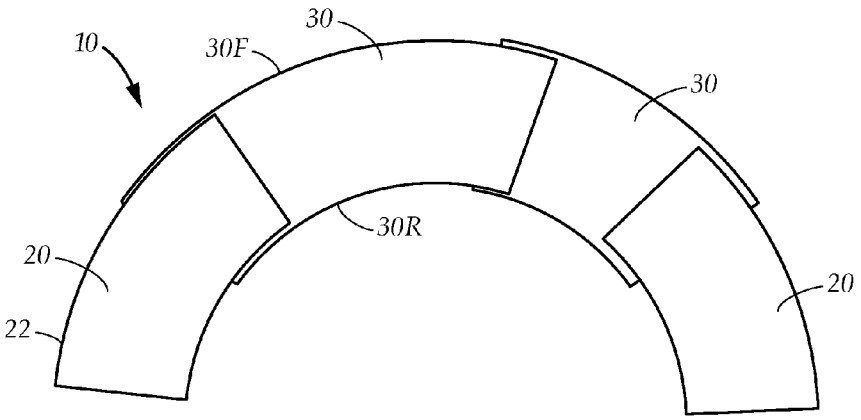
FIG. 6A is a diagrammatic perspective view of a third example embodiment of the article holding device, according to the present disclosure.
Figure 6B:
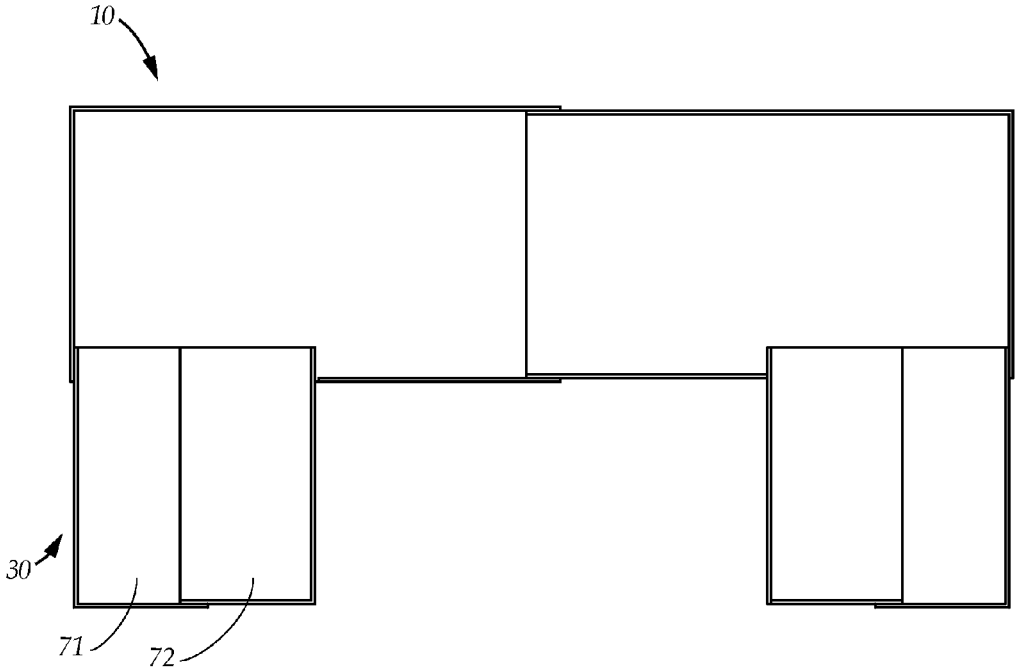
FIG. 6B is a diagrammatic perspective view of the first example embodiment of the article holding device, wherein each arm receptacle is further bifurcated to define a pair of adjustable arm receptacle subsets.

FIG. 6A illustrates another example embodiment of the device 10 including the telescoping front receptacles 30 and arm receptacles 20, wherein each of the front receptacles 30 and the arm receptacles 20 are arcuate and configured for transitioning between the retracted and deployed positions, as described hereinbelow. It is understood that the device 10 can have any shape which enables the front receptacles and pair of arm receptacles to operably deploy into, and retract from one another. It is further understood that the receptacles can include any number or orientation of walls which enables the adjustable, telescoping movement of the receptacles, according to the present disclosure. For instance, in FIG. 6A, the side walls 22 of the arm receptacles 20 are configured to slide along the width of the front walls 30F and the rear walls 30R of the front receptacles 30 when retracting and deploying therefrom.

Figure 3:
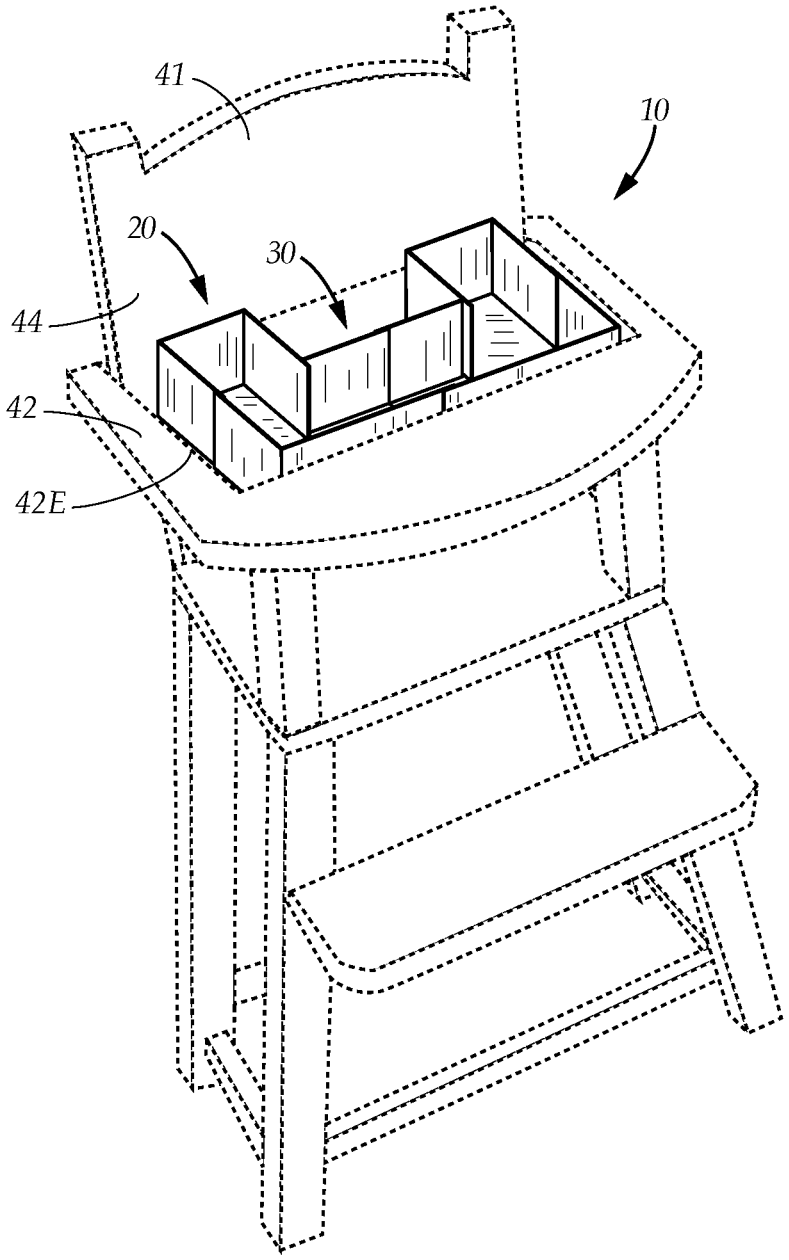
FIG. 3 is a diagrammatic perspective view of the deployed device employed with a high chair, according to the present disclosure.

FIG. 3 illustrates an example embodiment of the device 10 employed with a seat 41, such as a high chair. The seat 41 includes a front tray surface 42 and a back 44. The front tray surface 42 has an interior edge 42E defining an area configured to receive a user. Depending on the size of the user, however, an unoccupied space can remain between the user's body and the interior edge 42E. Accordingly, the device 10 can be oriented within the seating area, such as on the lap of the user to partially and/or wholly fill the unoccupied space. The device 10 can then be operably adjusted in length and width via the telescoping arm receptacles 20 and the telescoping front receptacles 30 to conform to the size and shape of the user's body. Alternatively, the device 10 can be adjusted to extend along the interior edge 42E of the front tray surface 42. The arm receptacles 20 can be fully deployed towards the back 44 of the chair 41, as illustrated, to create a full receptacle perimeter around the front and sides of the user's body. Further, should the device 10 exceed beyond the unoccupied space when adjusted around the user's body, it is understood that the device 10 can extend under and/or over the tray surface 42.

Figure 4:
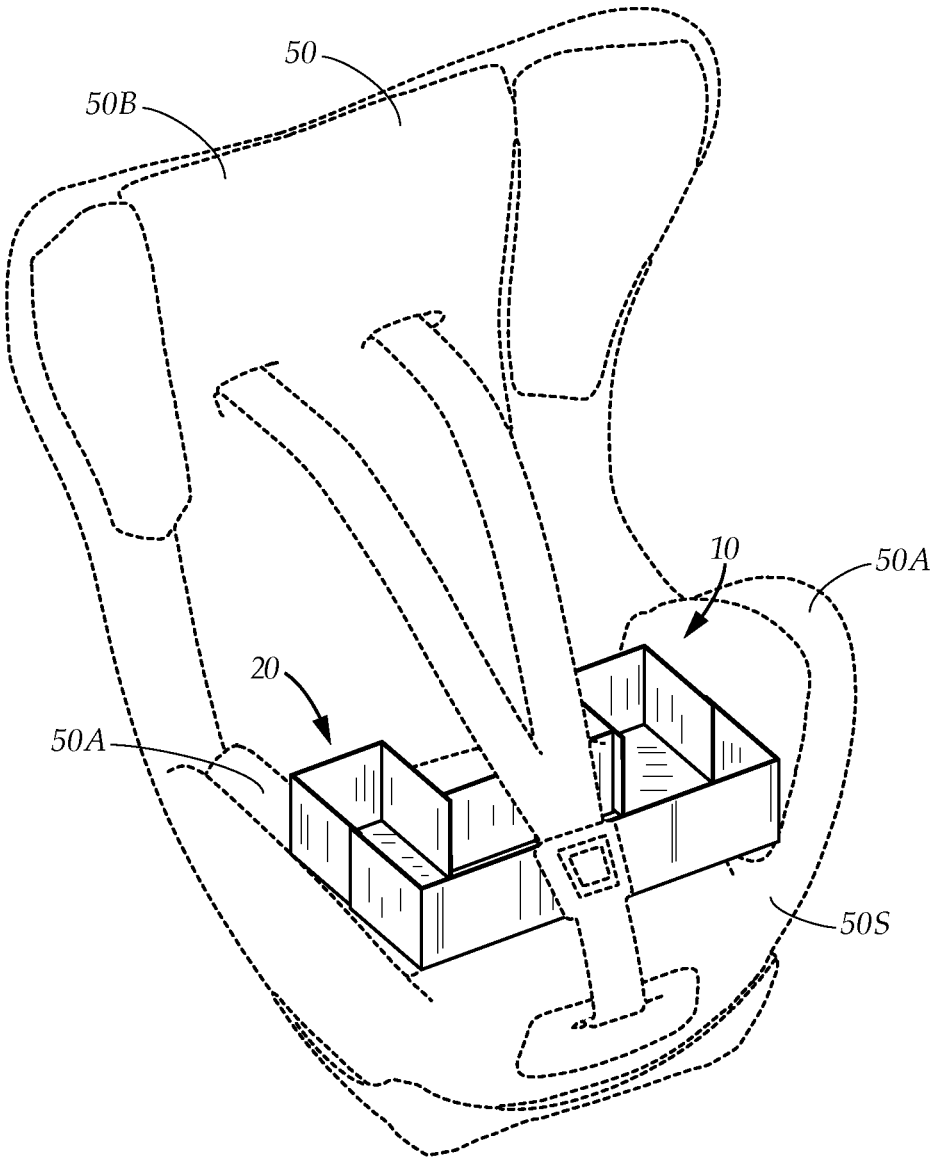
FIG. 4 is a diagrammatic perspective view of the deployed device employed with a car seat, according to the present disclosure.

FIG. 4 illustrates the device 10 in use with a car seat 50 having a restraint. The car seat 50 traditionally includes a back 50B, a seat portion 50S, and a pair of side bolsters 50A which extend outwardly and upwardly away from the back and seat, respectively, to securely support and anchor a user seated therein. The device can be oriented between the user and the restraint, or around both the user and the restraint. The adjustable arm receptacles 20 can be deployed to a shorter length to accommodate the outwardly extending side bolsters 50A of the seat 50. Additionally, the width of the arm receptacles 20 can be contracted, as described hereinabove, to insert the arm receptacles 20 within the often limited space present between the user and the side bolsters 50A of the car seat 50.

Figure 2D:
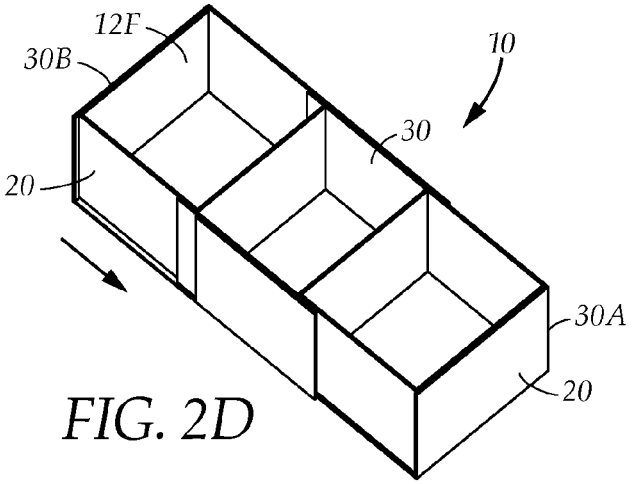
FIG. 2D is a diagrammatic perspective view of the device including the front receptacles in a partially contracted position, according to the present disclosure.
Figure 2E:
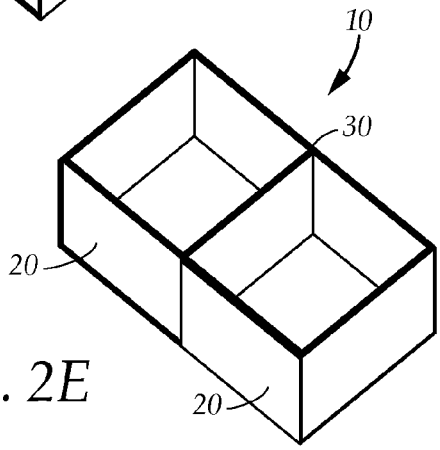
FIG. 2E is a diagrammatic perspective view of the device in a fully retracted position, according to the present disclosure.

FIGS. 2A-2E illustrate a method of use of an example embodiment of the device 10. FIG. 2A illustrates the device in a fully deployed position. It is understood that the front portion 12 and the arm receptacles 20 can be expanded independently and/or uniformly to enable operative use of the device 10 within variable chairs and seats. The step of retracting the arm receptacles 20 into their associated front receptacles 30 is enabled by sliding the arm receptacles 20 inwardly towards the opposing ends 12F, 12S of the front portion 12, preferably until the arm rear walls 20R and the front portion rear walls 30R are contiguous, as illustrated in FIG. 2B. The step of collapsing the front portion 12 is first enabled by laterally sliding the first receptacle 30A over the second receptacle 30B, as illustrated in FIG. 2C. The user then continues to slide the first receptacle 30A towards the first end 12F of the front portion 12 until both the first receptacle 30A and the arm receptacles 20 previously contracted and positioned therein are oriented and stacked within the second receptacle 30B, as illustrated in FIG. 2D. FIG. 2E illustrates the device 10 in a fully retracted position.

Figure 13A:
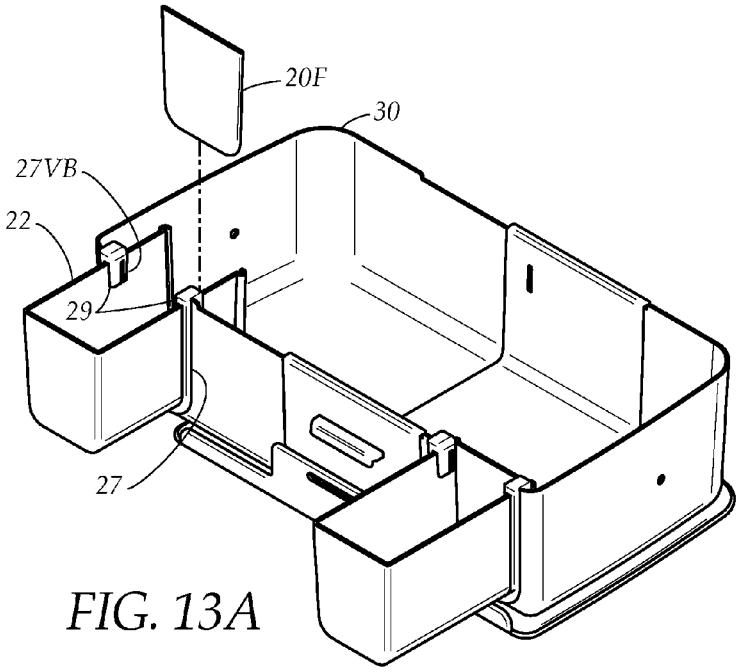
FIG. 13A, FIG. 13B, and FIG. 13C, illustrate an embodiment of the device that allows the arm receptacles to be removed, and openings in the front receptacles to be closed with cover plates in the absence of the arm receptacles.
Figure 13B:
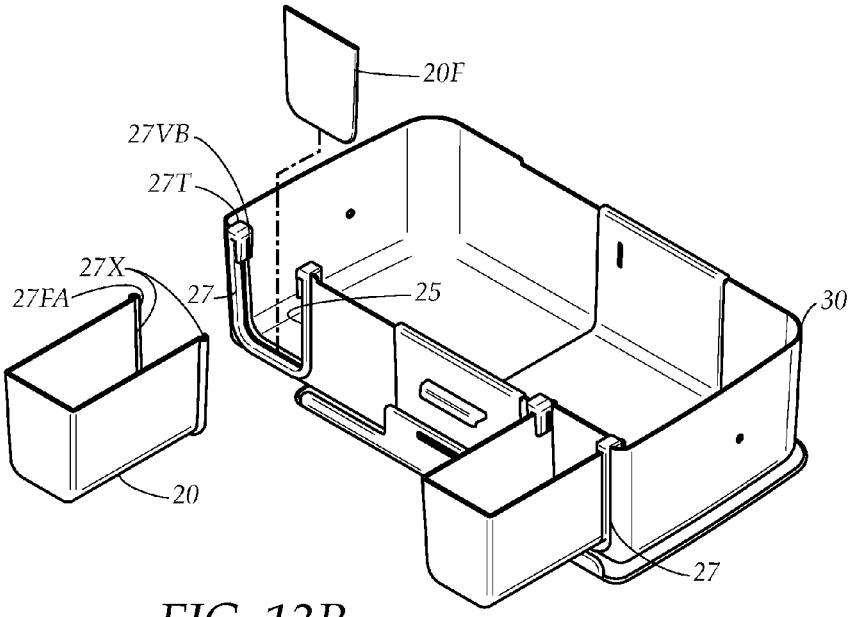
Figure 13C:
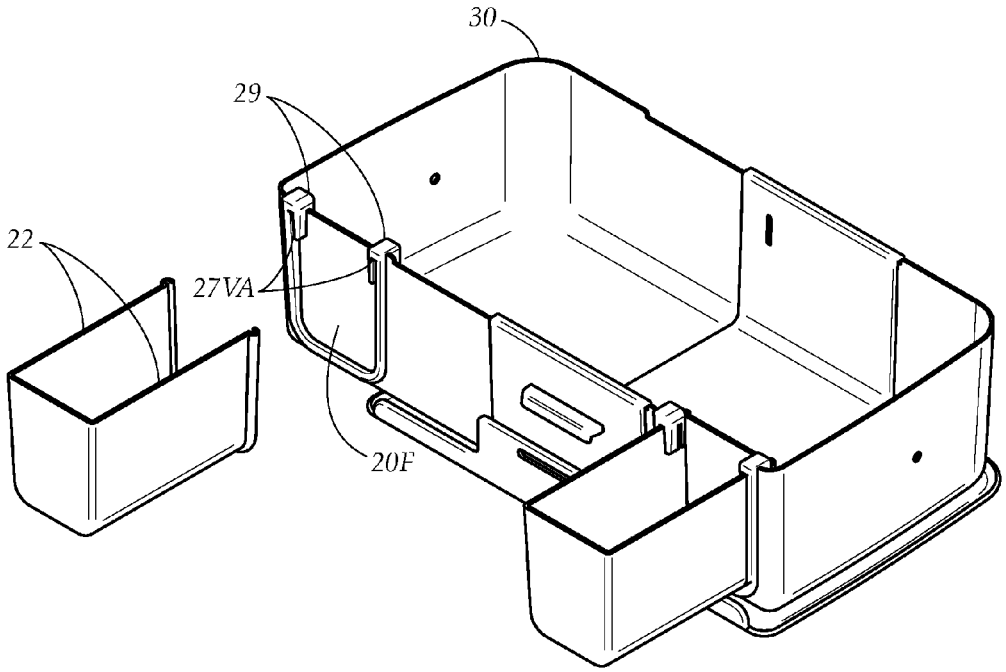
Figure 14:
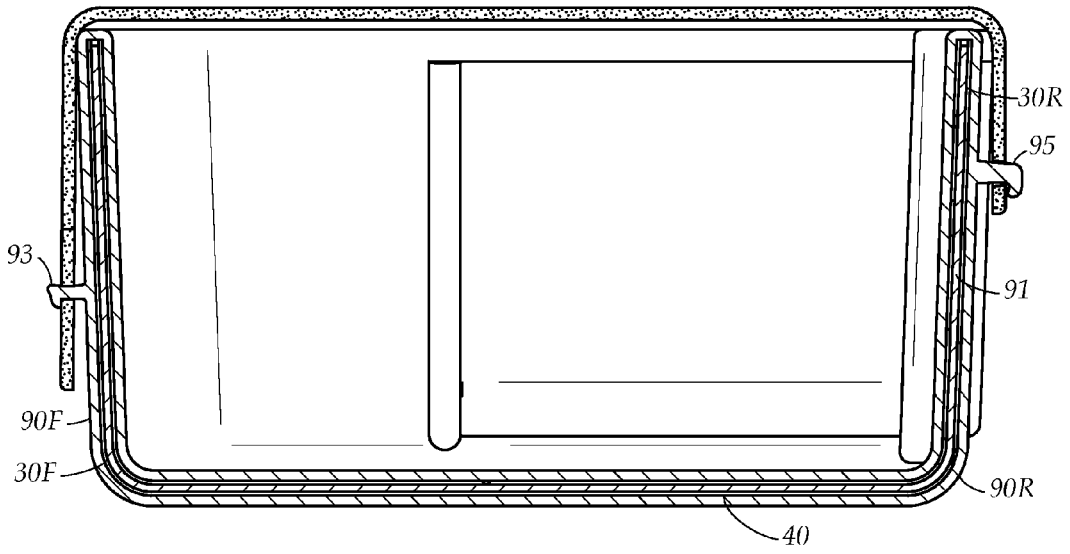
FIG. 14 is a side elevational view, with parts broken away, illustrating the nested structure that permits slidable adjustment of the front receptacles within the center front sleeve.
Figure 15:
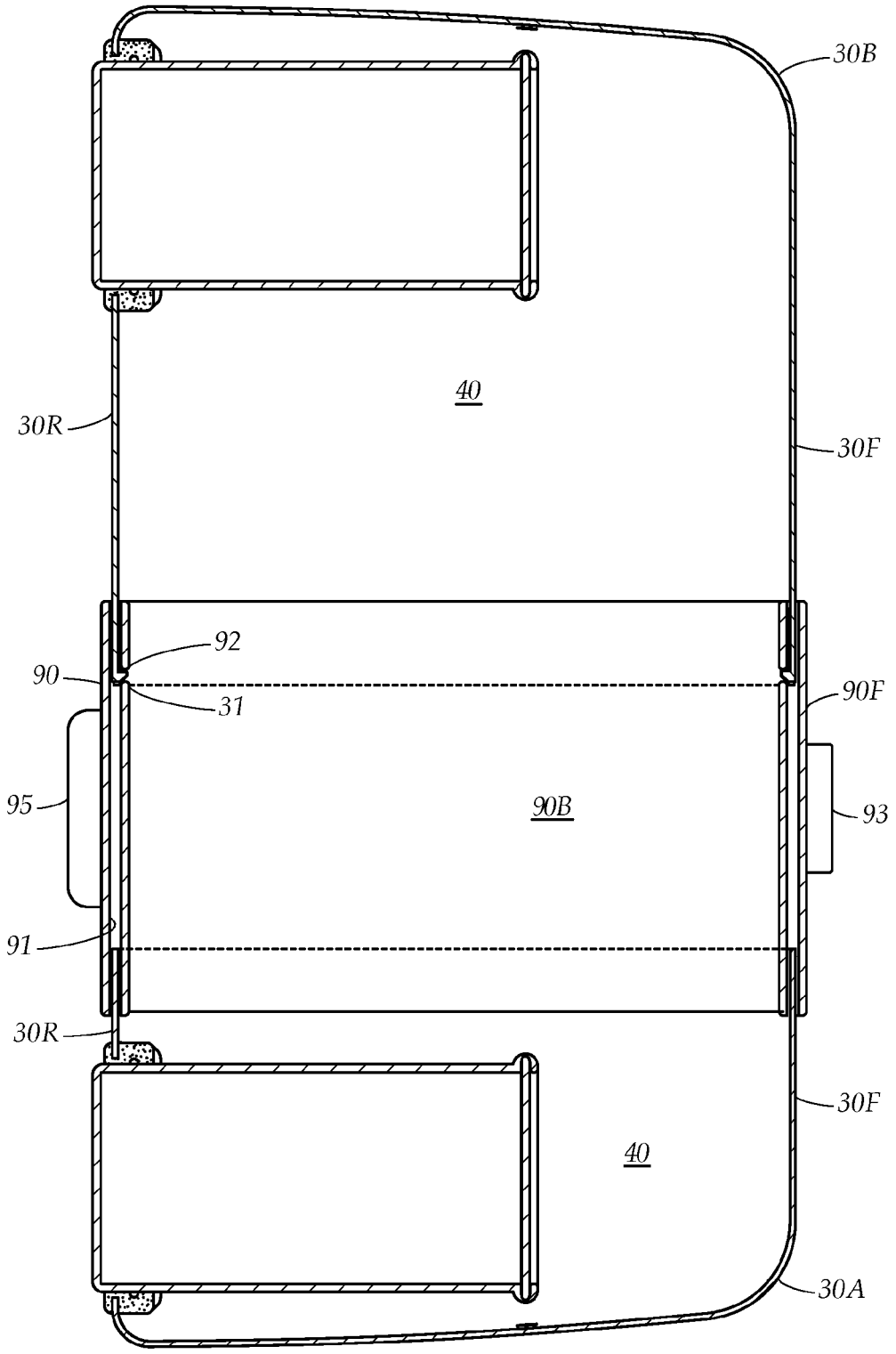
FIG. 15 is a top plan view with parts broken away, illustrating interconnection of the front receptacles with the center front sleeve, as well as interconnection of the arm receptacles within the front receptacles.

FIG. 8-FIG. 15 illustrate a further embodiment of the device 10. Notably, in this embodiment the device 10 has a center sleeve 90 having a first end 901 and second end 902. In particular, the center sleeve 90 joins the front receptacles 30A, 30B together and allows relative positional adjustment thereof. The center sleeve 90 is a generally U-shaped item, having a bottom wall 90B, a front wall 90F, and a rear wall 90R. Referring to FIG. 14 and FIG. 15, the bottom wall 90B, front wall 90F, and rear wall 90R are all double walls, having a sliding channel 91 therewithin for accommodating the front walls 30F, rear walls 30R and base portions 40 of the front receptacles 30, and selectively allowing at least one of the front receptacles 30A, 30B to slide therewithin, with front receptacle 30A extending into the first end 901 and front receptacle 30B extending into the second end 902.

Figure 9A:
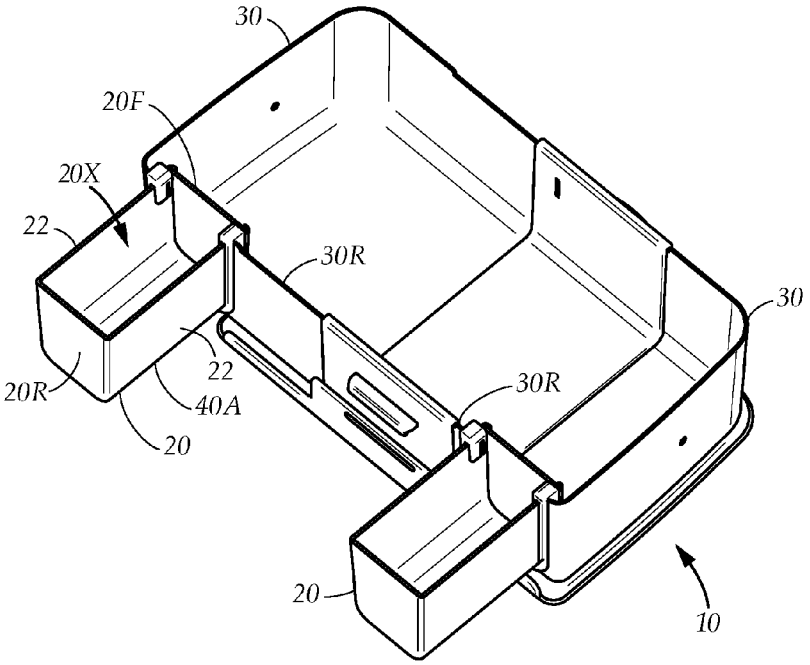
FIG. 9A is a diagrammatic perspective view, similar to FIG. 8, except wherein the strap has been removed.
Figure 9B:
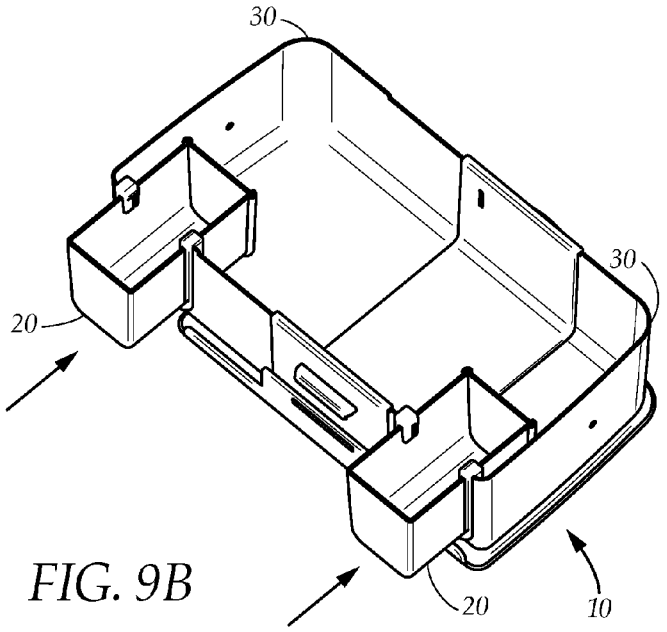
FIG. 9B is a diagrammatic perspective view, similar to FIG. 9A, illustrating the arm receptacles being retraced into the front receptacles.
Figure 9C:
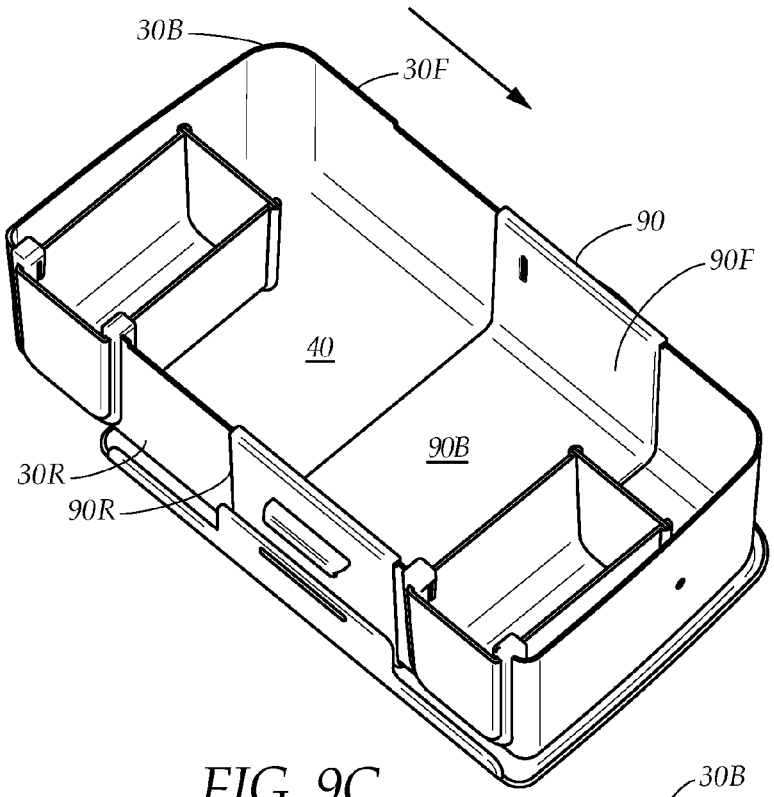
FIG. 9C and FIG. 9D are diagrammatic perspective views, similar to FIG. 9B, except wherein the arm receptacles are fully retracted, and one of the front receptacles retracting within the center sleeve.
Figure 9D:
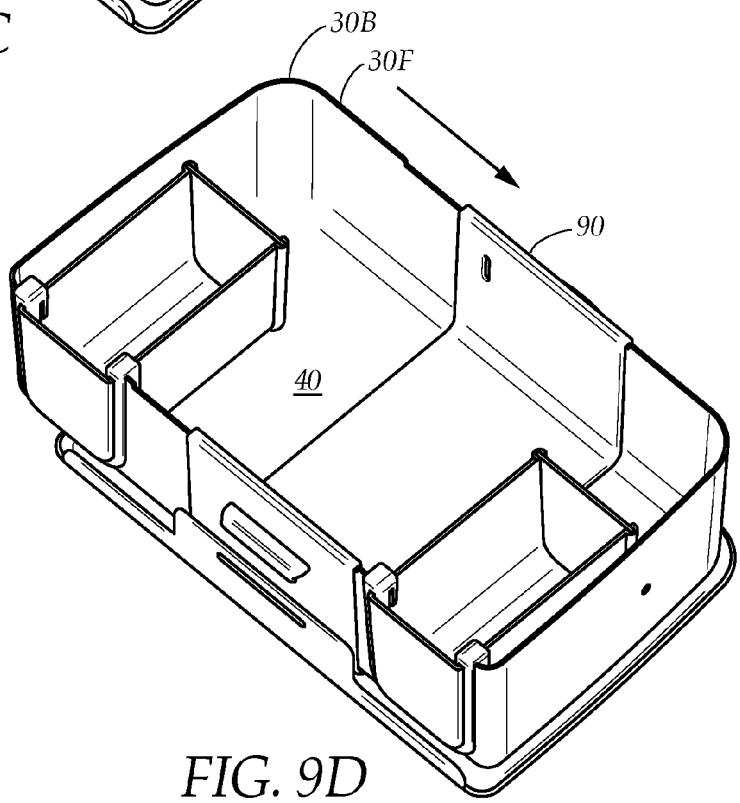
Figure 9E:
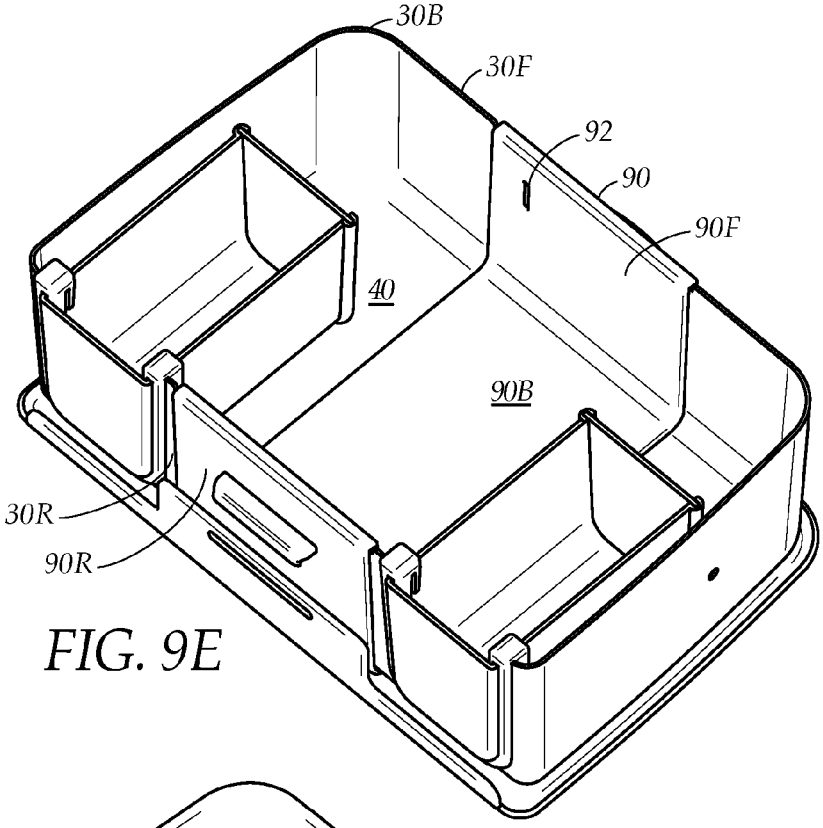
FIG. 9E is a diagrammatic perspective view, similar to FIGS. 9C and 9D, except wherein the front receptacles are now fully retracted within the center sleeve.
Figure 9F:
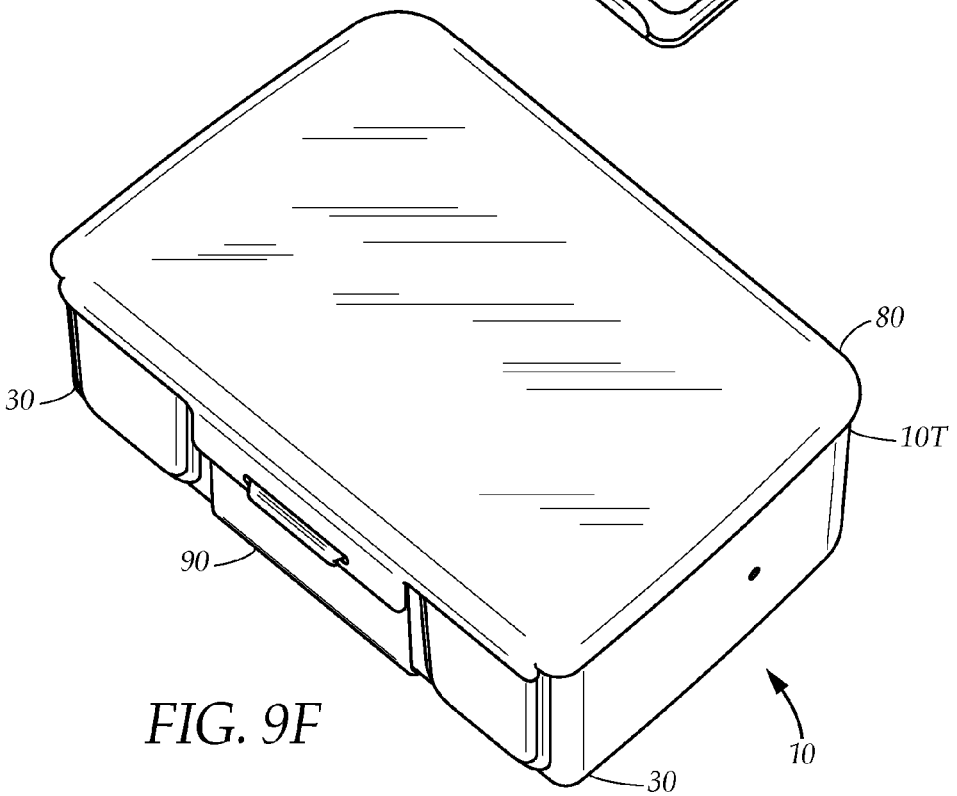
FIG. 9F is a diagrammatic perspective view, similar to FIG. 9E, except wherein the lid has been removed from its storage position beneath the device, and is now covering the main cavity.

Referring then to FIGS. 9C, 9D, and 9E, front receptacle 30B is shown retracting into the center sleeve 90. In particular, the front wall 30F, rear wall 30R, and base portion 40 of said front receptacle 30B, are illustrated as retracting into the front wall 90F, rear wall 90R, and bottom wall 90B of the center sleeve 90. As seen in FIG. 15, front receptacle 30A may be configured to be fixed in position with respect to the center sleeve 90, while front receptacle 30B is configured to be slidable with respect to the center sleeve 90, to adjust the relative position of the front receptacles 30A, 30B. In addition, the center sleeve 90 may have a catch opening 92 (also see FIG. 8) on its front wall 90F and rear wall 90R, while front receptacle 30B has a catch 31, terminating its front wall 30F and rear wall 30R. Accordingly, to prevent the front receptacle 30B from sliding fully out of the center sleeve 90, the catch 31 will fall into the catch opening 92 to prevent further movement of front receptacle 30B away from front receptacle 30A. Note that the center sleeve 90 would thereby be made of a material with sufficient flexibility so as to allow the sliding channel 91 to flex slightly on an inward push of the front receptacle 30B to allow the catch 31 to exit the catch opening 92 and re-enter the sliding channel 91. Also note that with the front receptacles 30 fully retracted into the center sleeve 90 as shown in FIG. 9F, the lid 80 can secure onto the top 10T of the device 10.

Figure 12A:
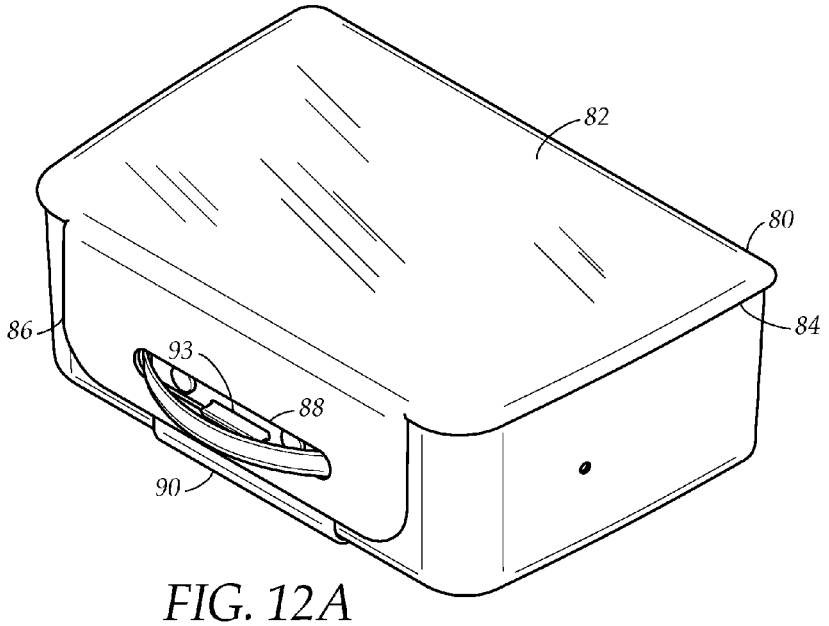
FIG. 12A and FIG. 12B are diagrammatic perspective views that illustrate alternate positions for the lid, both being used to cover the main cavity and stored beneath the device.
Figure 12B:
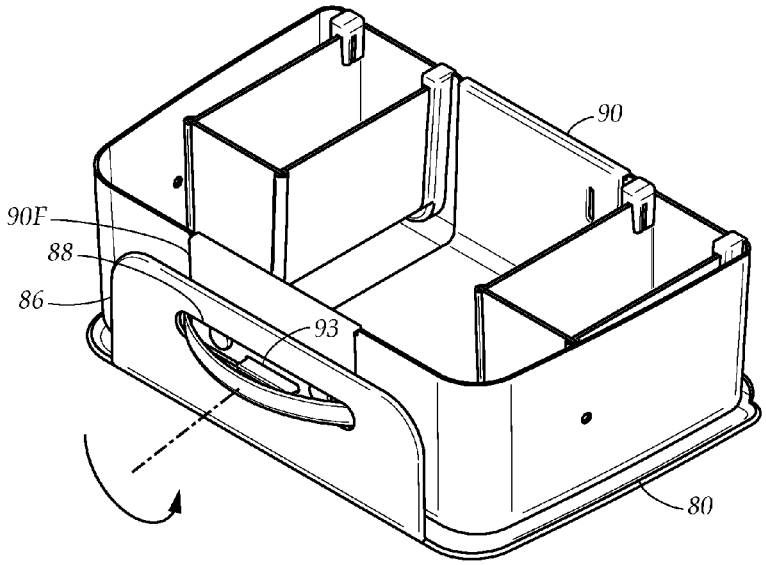

Referring to FIG. 12A and FIG. 12B, the lid 80 has a main surface 82 which is substantially broad and flat, a perimeter 84, and a transverse tab 86 that extends perpendicularly to the main surface 82. The transverse tab 86 has a broad opening 88. The central sleeve 90 has a protrusion 93 on its front wall 90F. The protrusion is positioned on the front wall 90F, and the broad opening 88 is positioned on the transverse tab 86 so that the protrusion 93 will extend through the broad opening 88 whether the lid 80 is positioned on the top 10T of the device 10, or is inverted and placed under the bottom 10B of the device. Referring to FIG. 14, the protrusion 93 may be configured with a hook or latching mechanism, so as to engage the broad opening 88 and help keep the lid 80 in place. In addition, an auxiliary protrusion 95 may be provided on the rear wall 90R the central sleeve 90, to additionally help retain the lid 80 when mounted on the top 10T of the device 10.

FIG. 9A and FIG. 9B illustrate movement of the arm receptacles 20 with respect to the front receptacles 30 of the device 10. In particular, the arm receptacles 20 are configured to slidably deploy outwardly from the rear walls 30R of the front receptacles 30, and to retract nearly fully therein. Note that in the configuration illustrated, the arm receptacles define an interior space 20X, with its base portion 40A, side walls 22, rear wall 20R, and with a removable front wall 20F.

Referring to FIGS. 13A, 13B, and 13C, each front receptacle 30 has an arm bracket 27 associated with its receptacle opening 25. The arm bracket 27 is substantially U-shaped, having a top 27T, and is generally open upwardly at the top 27T except having a pair of overhangs 29 that somewhat narrow the openness at the top 27T. The overhangs 29 each have a downwardly facing vertical slot 27VA that retain the side walls 22 of the associated arm receptacle 20.

Each arm receptacle 20 has a front edge 20FA, and has a front edge slot 20X extending vertically in the side walls 22 near the front edge 20FA. The front edge slot 20X allowing the removable front wall 20F to be inserted downwardly thereinto, as shown in FIG. 13A, to complete the interior space formed with the base portion 40A, side walls 22, and rear wall 20R of said arm receptacle 20.

The overhangs 29 additionally have opposing vertical slots 27VB, that face each other within the opening between the overhangs 29. The opposing vertical slots 27VB allow the removable front wall 20F to be inserted downwardly therethrough, as indicated by FIG. 13B such that they span within the arm bracket 27, to essentially fill the space within when the arm receptacle 20 is fully removed from its associated front receptacle 30, as indicated by FIG. 13C.

Figure 10:
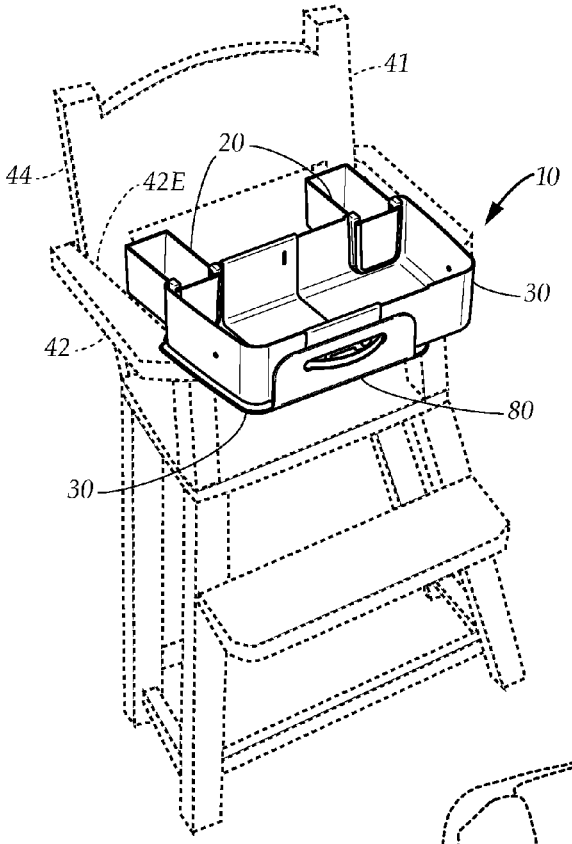
FIG. 10 is a diagrammatic perspective view of the deployed device employed with a high chair, according to the present disclosure.

FIG. 10 illustrates the present embodiment of the device 10 employed with the seat 41 previously indicated in FIG. 3. Depending on the size of the user, an unoccupied space can remain between the user's body and the interior edge 42E. Accordingly, the device 10 can be oriented within the seating area, such as on the lap of the user to partially and/or wholly fill the unoccupied space. The lid 80 may be placed beneath the device 10, and rest upon the lap of the user. The device 10 can then be operably adjusted in length and width via the telescoping arm receptacles 20 and the telescoping front receptacles 30 to conform to the size and shape of the user's body. Alternatively, the device 10 can be adjusted to extend along the interior edge 42E of the front tray surface 42. The arm receptacles 20 can be fully deployed towards the back 44 of the chair 41, as illustrated, to create a full receptacle perimeter around the front and sides of the user's body. Further, should the device 10 exceed beyond the unoccupied space when adjusted around the user's body, it is understood that the device 10 can extend under and/or over the tray surface 42.

Figure 11:
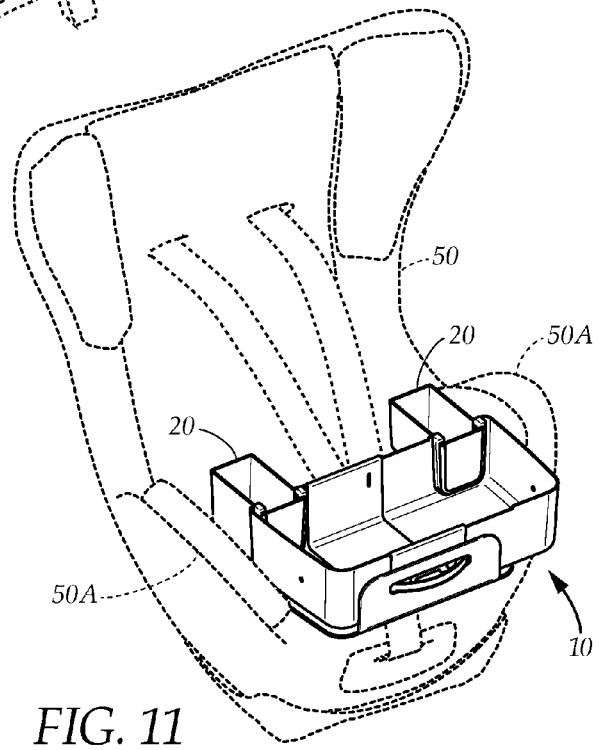
FIG. 11 is a diagrammatic perspective view of the deployed device employed with a car seat, according to the present disclosure.

FIG. 11 illustrates this embodiment of the device 10 in use with the car seat 50 having a restraint, as previously seen in FIG. 4. The device can be oriented between the user and the restraint, or around both the user and the restraint. The adjustable arm receptacles 20 can be deployed to a shorter length to accommodate the outwardly extending side bolsters 50A of the seat 50. Additionally, the width of the arm receptacles 20 can be contracted, as described hereinabove, to insert the arm receptacles 20 within the often limited space present between the user and the side bolsters 50A of the car seat 50.

It is understood that when an element is referred hereinabove as being "on" another element, it can be directly on the other element or intervening elements may be present therebetween. In contrast, when an element is referred to as being "directly on" another element, there are no intervening elements present.

Moreover, any components or materials can be formed from a same, structurally continuous piece or separately fabricated and connected.

It is further understood that, although ordinal terms, such as, "first," "second," "third," are used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

Spatially relative terms, such as "beneath," "below," "lower," "above," "upper" and the like, are used herein for ease of description to describe one element or feature's relationship to another element(s) or feature(s) as illustrated in the figures. It is understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device can be otherwise oriented (rotated 90 degrees or at other orientations) and the spatially relative descriptors used herein interpreted accordingly.

Example embodiments are described herein with reference to cross section illustrations that are schematic illustrations of idealized embodiments. As such, variations from the shapes of the illustrations as a result, for example, of manufacturing techniques and/or tolerances, are to be expected. Thus, example embodiments described herein should not be construed as limited to the particular shapes of regions as illustrated herein, but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

In conclusion, herein is presented an article holding device. The disclosure is illustrated by example in the drawing figures, and throughout the written description. It should be understood that numerous variations are possible, while adhering to the inventive concept. Such variations are contemplated as being a part of the present disclosure.

What is claimed is:

1. A portable article holding tray, comprising:

a top;

a bottom;

a pair of front receptacles, each of the front receptacles having an outer side wall, a front wall, and a base portion at the bottom, the front wall, outer side wall, and base portion are joined together at substantially right angles, the outer side walls of the front receptacles fully opposite from each other, the front walls and the base portions of the front receptacles are substantially coextensive with each other, the front receptacles adapted for slidable movement with respect to each other such that the outer side walls can move toward and away from each other, the front receptacles each having a rear wall and a receptacle opening between the rear wall and the side wall;

a pair of arm receptacles, the arm receptacles each having a rear wall, a base portion, and a side wall, each of the arm receptacles slidably mounted within the receptacle opening, allowing the arm receptacle to extend outwardly from the front receptacles or to retract nearly fully into one of the front receptacles such that the side walls base portion, rear wall and bottom wall of said arm receptacle to substantially overlay the base portion of said one of the front receptacles; and wherein the front receptacles and arm receptacles generally define a main cavity that is substantially closed at the bottom and open at the top.

2. The portable article holding tray as recited in claim 1, wherein the rear walls of the front receptacles are substantially coextensive, such that the slide along each other as the front receptacles slidably move with respect to each other.

3. The portable article holding tray as recited in claim 2, wherein the base portions of the front receptacles each have an interior lateral edge extending between the front wall and rear wall of said front receptacle, said interior lateral edge is open between said front wall and rear wall of said front receptacle.

4. The portable article holding tray as recited in claim 3, further comprising a center sleeve that is substantially U-shaped, having a first end, a second end, a front wall, a bottom wall, and a rear wall which are all double walls having a sliding channel therein, the sliding channel extending between the first end and second end, the center sleeve extending between the front receptacles wherein one of the front receptacles enters the sliding channel at the first end and the other of the front receptacles enters the sliding channel at the second end, such that the front wall, base portion, and rear wall of each of the front receptacles extend within the front wall, bottom wall, and rear wall of the center sleeve.

5. The portable article holding tray as recited in claim 4, further comprising a pair of arm brackets, each arm bracket substantially U-shaped and mounted within one of the receptacle openings, each arm bracket is generally open upwardly to allow the side walls and base portion of one of the arm receptacles to slide therein, and has a pair of overhangs that each having a downwardly facing vertical slot for retaining one of the side walls of the said arm receptacle to keep said arm receptacle from moving upwardly as said arm receptacle slides laterally within said arm bracket.

6. The portable article holding tray as recited in claim 5, wherein each arm receptacle has a front edge having a front edge slot, and a removable front wall that selectively slides into the front edge slot to define an interior volume with the side walls, rear wall, and base portion of said arm receptacle.

7. The portable article holding tray as recited in claim 6, wherein the overhangs for each arm bracket have a pair of opposing vertical slots, the opposing vertical slots allow the removable front wall to be placed downwardly therethrough to span within the arm bracket.

8. The portable article holding tray as recited in claim 7, further comprising a lid having a main surface, a perimeter, and a transverse tab extending perpendicularly from the perimeter, the transverse tab having a broad opening extending therethrough, wherein the central sleeve has a protrusion on the front wall that fits through the broad opening such that the protrusion can extend through the broad opening when the lid is positioned both with its main surface against the bottom and against the top.

9. The portable article holding device as recited in claim 8, wherein the lid is sized to fit against the top when the front receptacles are fully retracted toward each other and the arm receptacles are fully retracted into the front receptacles.

10. A portable article holding tray, for use adjacent to the lap of a person, for retaining items and for catching falling items, comprising:

a top;

a bottom;

a pair of front receptacles, each of the front receptacles having an outer side wall, a front wall, and a base portion at the bottom, the front wall, outer side wall, and base portion are joined together at substantially right angles, the outer side walls of the front receptacles fully opposite from each other, the front walls and the base portions of the front receptacles are substantially coextensive with each other, the front receptacles adapted for slidable movement with respect to each other such that the outer side walls can move toward and away from each other, the front receptacles each having a rear wall and a receptacle opening between the rear wall and the side wall;

a pair of arm receptacles, the arm receptacles each having a rear wall, a base portion, and a side wall, each of the arm receptacles slidably mounted within the receptacle opening, allowing the arm receptacle to extend outwardly from the front receptacles or to retract nearly fully into one of the front receptacles such that the side walls base portion, rear wall and bottom wall of said arm receptacle to substantially overlay the base portion of said one of the front receptacles;

a center sleeve that is substantially U-shaped, having a first end, a second end, a front wall, a bottom wall, and a rear wall which are all double walls having a sliding channel therein, the sliding channel extending between the first end and second end, the center sleeve extending between the front receptacles wherein one of the front receptacles enters the sliding channel at the first end and the other of the front receptacles enters the sliding channel at the second end, such that the front wall, base portion, and rear wall of each of the front receptacles extend within the front wall, bottom wall, and rear wall of the center sleeve; and wherein the front receptacles and arm receptacles generally define a main cavity that is substantially closed at the bottom and open at the top.

11. The portable article holding tray as recited in claim 10, wherein the base portions of the front receptacles each have an interior lateral edge extending between the front wall and rear wall of said front receptacle, said interior lateral edge is open between said front wall and rear wall of said front receptacle and extends into the sliding channel of the center sleeve.

12. The portable article holding tray as recited in claim 11, further comprising a lid having a main surface, a perimeter, and a transverse tab extending perpendicularly from the perimeter, the transverse tab having a broad opening extending therethrough, wherein the central sleeve has a protrusion on the front wall that fits through the broad opening such that the protrusion can extend through the broad opening when the lid is positioned both with its main surface against the bottom and against the top.

13. The portable article holding tray as recited in claim 12, wherein the lid is sized to fit against the top when the front receptacles are fully retracted toward each other and the arm receptacles are fully retracted into the front receptacles.

14. The portable article holding tray as recited in claim 13, further comprising a pair of arm brackets, each arm bracket substantially U-shaped and mounted within one of the receptacle openings, each arm bracket is generally open upwardly to allow the side walls and base portion of one of the arm receptacles to slide therein, and has a pair of overhangs that each retain one of the side walls of the said arm receptacle to keep said arm receptacle from moving upwardly as said arm receptacle slides laterally within said arm bracket.

15. The portable article holding tray as recited in claim 14, wherein each arm receptacle has a front edge having a front edge slot, and a removable front wall that selectively slides into the front edge slot to define an interior volume with the side walls, rear wall, and base portion of said arm receptacle.

16. The portable article holding tray as recited in claim 15, wherein the overhangs for each arm bracket have a pair of opposing vertical slots, the opposing vertical slots allow the removable front wall to be placed downwardly therethrough to span within the arm bracket.

* * * * *